US006745500B2

(12) United States Patent
Suzuki et al.

(10) Patent No.: US 6,745,500 B2
(45) Date of Patent: Jun. 8, 2004

(54) SHOE WITH BELT FASTENING MEANS OF IMPROVED FITTABLITY

(75) Inventors: Kazuhiko Suzuki, Osaka (JP); Kenjiro Kita, Osaka (JP); Yoshimasa Shinomura, Osaka (JP)

(73) Assignee: Mizuno Corporation, Osaka (JP)

( * ) Notice: Subject to any disclaimer, the term of this patent is extended or adjusted under 35 U.S.C. 154(b) by 55 days.

(21) Appl. No.: 10/127,857

(22) Filed: Apr. 23, 2002

(65) Prior Publication Data

US 2003/0029057 A1 Feb. 13, 2003

(30) Foreign Application Priority Data

Aug. 10, 2001 (JP) ..... 2001-243621
Mar. 19, 2002 (JP) ..... 2002-075933

(51) Int. Cl.[7] ..... A43B 11/00
(52) U.S. Cl. ..... 36/50.1
(58) Field of Search ..... 36/50.1, 88

(56) References Cited

U.S. PATENT DOCUMENTS 668,408 A * 2/1901 Kalina ..... 24/379.1
770,535 A * 9/1904 Phillips ..... 36/50.1
2,326,776 A * 8/1943 Gellman ..... 36/99
3,845,769 A * 11/1974 Shaw ..... 602/62
4,486,965 A 12/1984 Friton
5,271,130 A * 12/1993 Batra ..... 24/714.6
5,307,569 A * 5/1994 Melcher ..... 36/58.5
5,699,629 A 12/1997 Munschy

FOREIGN PATENT DOCUMENTS

JP 4-367602 * 12/1992

* cited by examiner

*Primary Examiner*—M. D. Patterson
(74) *Attorney, Agent, or Firm*—Troutman Sanders LLP; Gerald R. Boss; Ryan A. Schneider

(57) ABSTRACT

The present invention provides a belt fastening means that can improve fittability of a shoe and that can equally tighten an upper of the shoe to a wearer's foot without hindering the movement of the foot. A belt fastening means for a shoe includes a first belt member disposed mainly on a lateral side portion of an upper and a second belt member disposed mainly on a medial side portion of the upper. The first and second belt members are located at nearly symmetrical positions with respect to an opening portion. A proximal end portion of the first belt member is connected to a sole on the lateral side and a distal end portion thereof extends over the opening portion. The first belt member extends in a direction nearly perpendicular to a ridge line of an instep portion as viewed from a lateral side of the shoe. A proximal end portion of the second belt member is connected to the sole on the medial side and a distal end portion thereof extends over the opening portion. The second belt member extends in a direction nearly perpendicular to the ridge line of the instep portion as viewed from a medial side of the shoe. The second belt member is formed with an elongated aperture into which the first belt member is inserted. The first and second belt members are releasably secured on the instep portion through hook and loop fastening materials.

4 Claims, 6 Drawing Sheets

SHOE WITH BELT FASTENING MEANS OF IMPROVED FITTABLITY

CROSS-REFERENCE TO RELATED APPLICATIONS AND CLAIM OF PRIORITY

This application claims priority from Japanese Patent Application No. 2001-243621, filed Aug. 10, 2001 and Japanese Patent Application No. 2002-75933, filed Mar. 19, 2002.

BACKGROUND OF THE INVENTION

The present invention relates to a shoe having a belt fastening means with at least a pair of belt members.

Conventionally, especially in a sports shoe, a fastening structure with a shoelace was commonly used to close and fasten an opening portion of a shoe to secure the upper of the shoe to a wearer's foot. Recently, a belt fastening means with a hook and loop fastening material has been used.

A belt fastening means of the prior art has a belt that is provided on one side of an opening portion of an upper and that has one piece of a hook and loop fastening material attached to a distal end of the belt. The other piece of the hook and loop fastening material is attached on the other side of the opening portion of the upper. By pulling the belt and fastening one piece of the hook and loop fastening material at the distal end of the belt to the corresponding other piece of the hook and loop fastening material on the upper, the belt is fastened to a shoe.

Such a belt fastening means is superior in that it eliminates the need to secure a shoelace with a knot and allows for easy opening and closing of the shoe. However, in fastening a belt, only one side of the upper relative to the opening portion is tightly pulled. As a result, the upper deforms and fittability of a shoe decreases.

An attempt was made to solve this problem in a shoe shown in Japanese Utility Model Application Examined Publication No. 62-35364 or Japanese Utility Model Application Unexamined Publication No. 59-16406. A belt fastening means described in these publications has a pair of belts provided on both sides of the upper and crossed in an X-shape over the opening portion. Each belt is detachably fastened on the upper through a hook and loop fastening material.

In such a belt fastening means, by pulling each belt, it is possible to pull opposite sides of the upper nearly equally. However, in this case, each belt is pulled in a diagonal direction relative to a shoe width direction over the opening portion of the upper, thereby causing a wrinkle on the upper, and it becomes difficult to secure the upper equally to a foot.

In a prior-art belt fastening means shown in FIG. 1 of the present application, each of the belts 100, 101 is pulled in a shoe width direction over an opening portion 110. However, in this case, the belt 100 adapted to pull a lateral side of the upper toward a medial side and the belt 101 adapted to pull the medial side of the upper toward the lateral side are shifted or offset in a longitudinal direction of the shoe. Thus, when each of the belts 100, 101 is pulled in an opposite direction, the upper is twisted, thereby decreasing fittability of the upper.

Japanese Patent Application Laying Open Publication No. 9-28413 shows a belt fastening means having a belt provided on one side of the upper and a D-shaped ring attached on the other side of the upper. By inserting the belt into the ring, folding back and pulling the belt, the opposite sides of the upper are nearly equally pulled and the upper is secured to a foot without twisting the upper. However, in this case, at the time of bending of a foot, D-shaped ring may interfere with a foot and hinder the movement of the foot.

The present invention is directed to solving the above-mentioned problems, and its object is to provide a shoe with a belt fastening means that can secure an upper equally to a foot and that can advance fittability without hindering the movement of a foot.

SUMMARY OF THE INVENTION

The present invention is directed to a belt fastening means with improved fittability for a shoe.

In one preferred embodiment, a shoe is formed of a sole and an upper attached to the sole. The upper has a longitudinally extending opening portion formed at an instep portion thereof. The instep portion has a medial and lateral side located on opposite sides of the opening portion, and a belt fastening means provided across the opening portion in a lateral direction. The belt fastening means is comprised of first and second belt members that are disposed at generally symmetrical positions with respect to the opening portion. Each of the first and second belt members extends in a direction generally perpendicular to "a ridge line" of the instep portion as viewed from a side of the shoe. Proximal end portions of the first and second belt members are connected to the sole and distal end portions thereof extend over the opening portion. The second belt member has an elongated aperture into which the first belt member is inserted. The elongated aperture may extend along the length of the second belt member and it faces the opening portion. The first and second belt members are releasably attached to the instep portion through hook and loop fastening materials provided on the belt members.

According to this embodiment, each of the first and second belt members extends in a direction generally orthogonal to "a ridge line" of the instep portion, or "a swell line" that extends from a position corresponding to a navicular bone of a wearer's foot to a position corresponding to a head of a metatarsus of a second or third toe, as viewed from a side of the shoe. And these belt members are disposed at symmetrical positions with respect to the opening portion. Thus, when pulling each distal end portion of the belt members in an opposite direction, the medial and lateral sides of the instep portion of the upper are equally pulled without causing torsion or wrinkles on the upper, thus securing the instep portion of the upper equally to a foot and making the whole surfaces of the belt members on the instep portion's side tightly contact with the instep portion. As a result, the whole instep of a wearer's foot can be supported in such a manner as to be wrapped by the upper of a shoe and fittability of the shoe can be improved.

Also, since each proximal end of the first and second belt members are connected to the sole, a foot can be tightly secured to the sole through extending portions of the belt members on the medial and lateral sides of the upper when each distal end portion of the taut belt members are fastened to the instep portion of the upper.

Moreover, in this case, not a slit but an elongated aperture extending along the length of the second belt member is formed in the second belt member and this elongated aperture faces the opening portion of the upper. Thus, insertion and extraction of the first belt member relative to the second belt member can be conducted with ease, and besides, individual differences of the height of an instep or the width of a foot can be absorbed and fittability can be maintained.

Furthermore, in this case, since each belt member is secured to the instep portion of the upper through a hook and loop fastening material without using a metal fitting such as a D-shaped ring, the movement of a foot is not hindered and a shoe wearer does not feel uncomfortable when bending a foot.

In another embodiment, each proximal end of the first and second belt members is connected to a sole through a reinforcement member or strip provided on the upper. In this case as well, as with the above-mentioned embodiment where each proximal end of the belt members is directly connected or fixed to a sole, when each distal end portion of the taut belt members is fastened to the instep portion, a wearer's foot can be tightly secured to the sole of a shoe through the medially and laterally extending portions of the belt members and the reinforcement members.

In still another embodiment, the second belt member is bifurcated at a region extending from a proximal end portion to an elongated aperture and a band-shaped tab is formed integrally with a distal end portion of the second belt member. In this case, when fastening belts, insertion and extraction of the first belt member relative to the second belt member can be conducted with more ease. Also, by utilizing the tab provided at the distal end portion of the second belt member, the second belt member can be easily gripped, thereby facilitating fastening of the belts.

In a further embodiment, a plurality of pairs of the first and second belt members are provided. In this case, a plurality of portions of the instep of a foot can be secured and fittability of a shoe can be further advanced.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
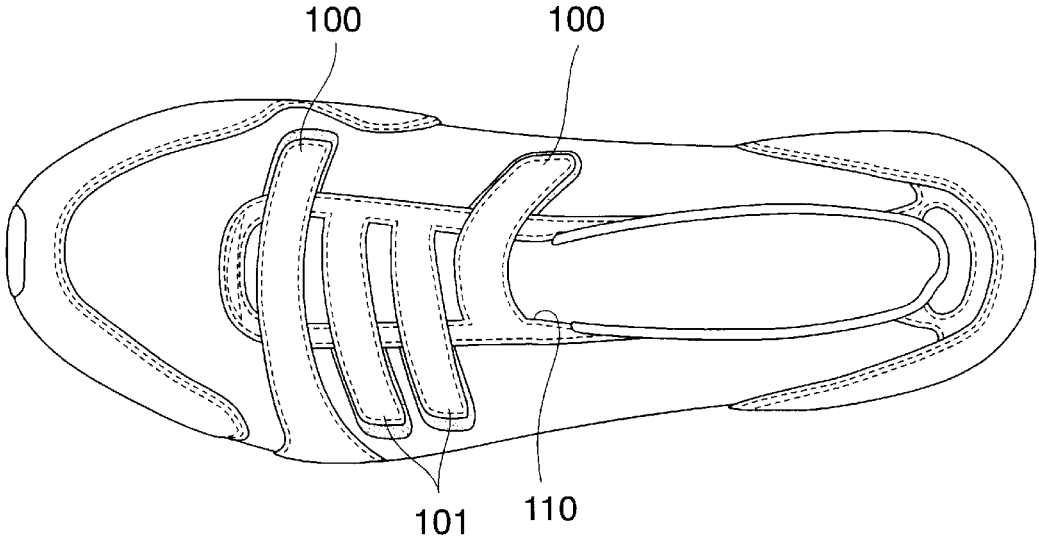
FIG. 1 PRIOR ART
FIG. 1 is a top plan view of a prior art shoe.
Figure 2:
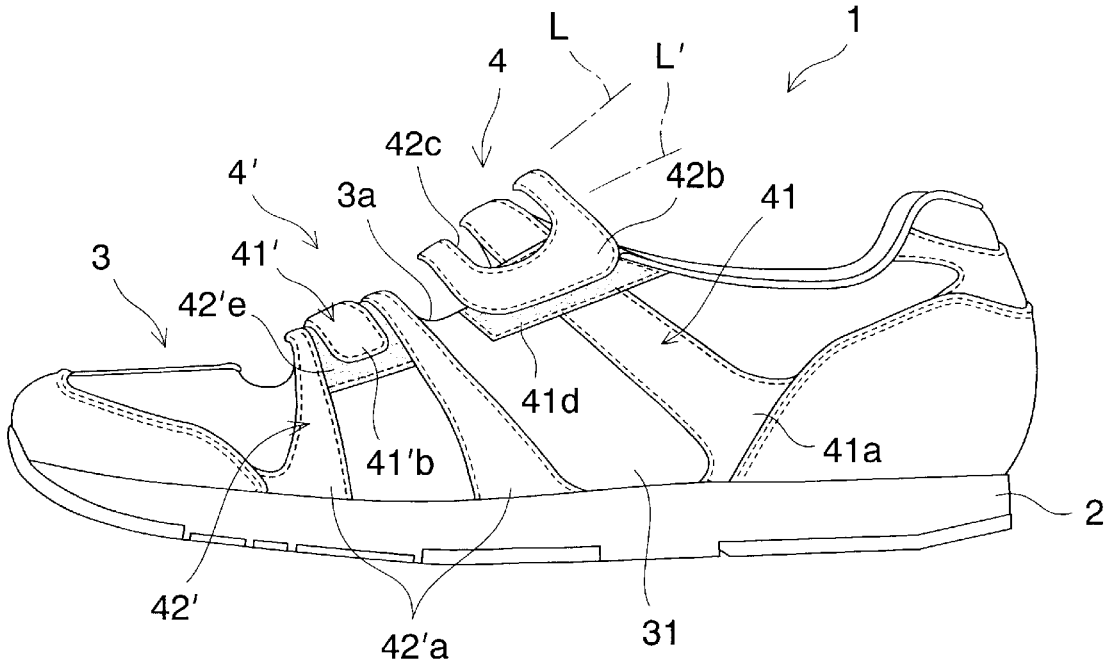
FIG. 2 is a lateral side view of a shoe with belt members fastened according to an embodiment of the present invention.
Figure 3:
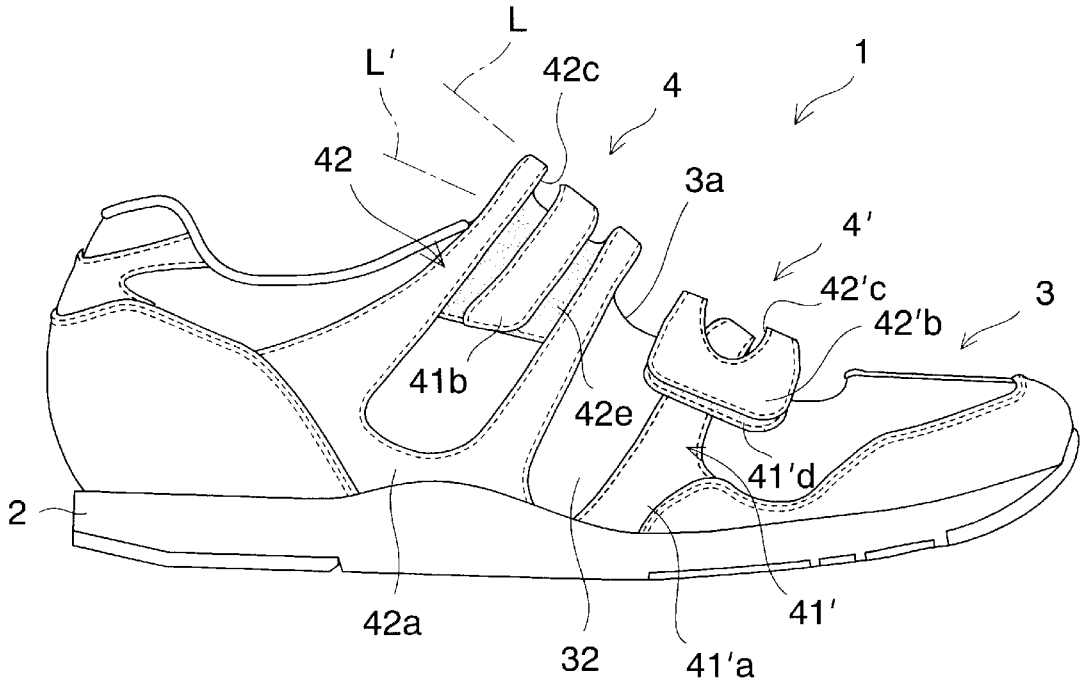
FIG. 3 is a medial side view of a shoe of FIG. 2.
Figure 4:
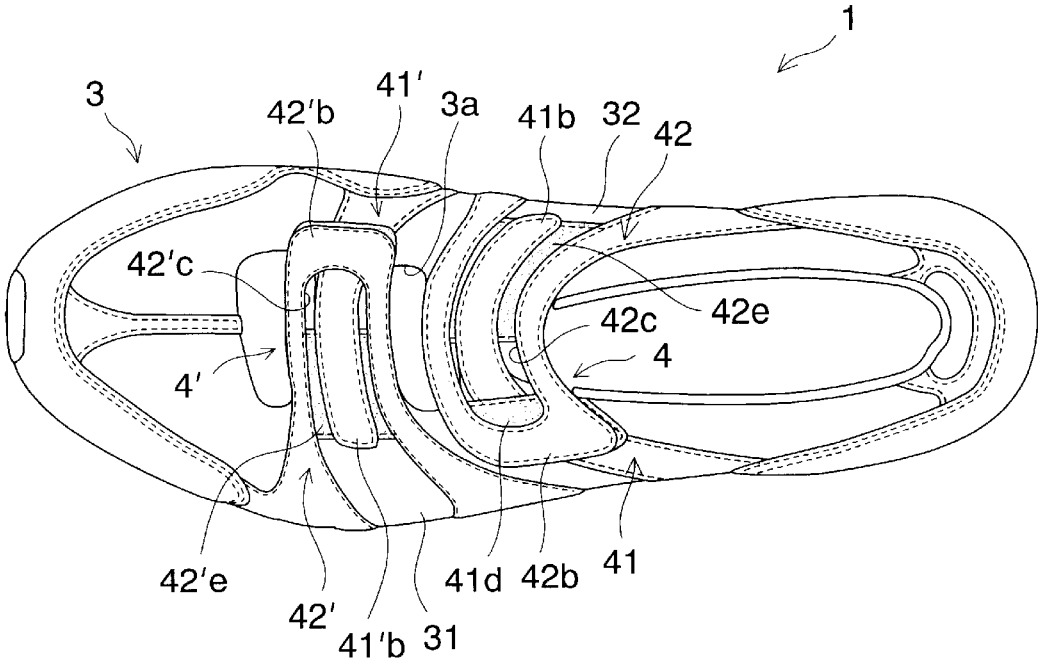
FIG. 4 is a top plan view of a shoe of FIG. 2.
Figure 5:
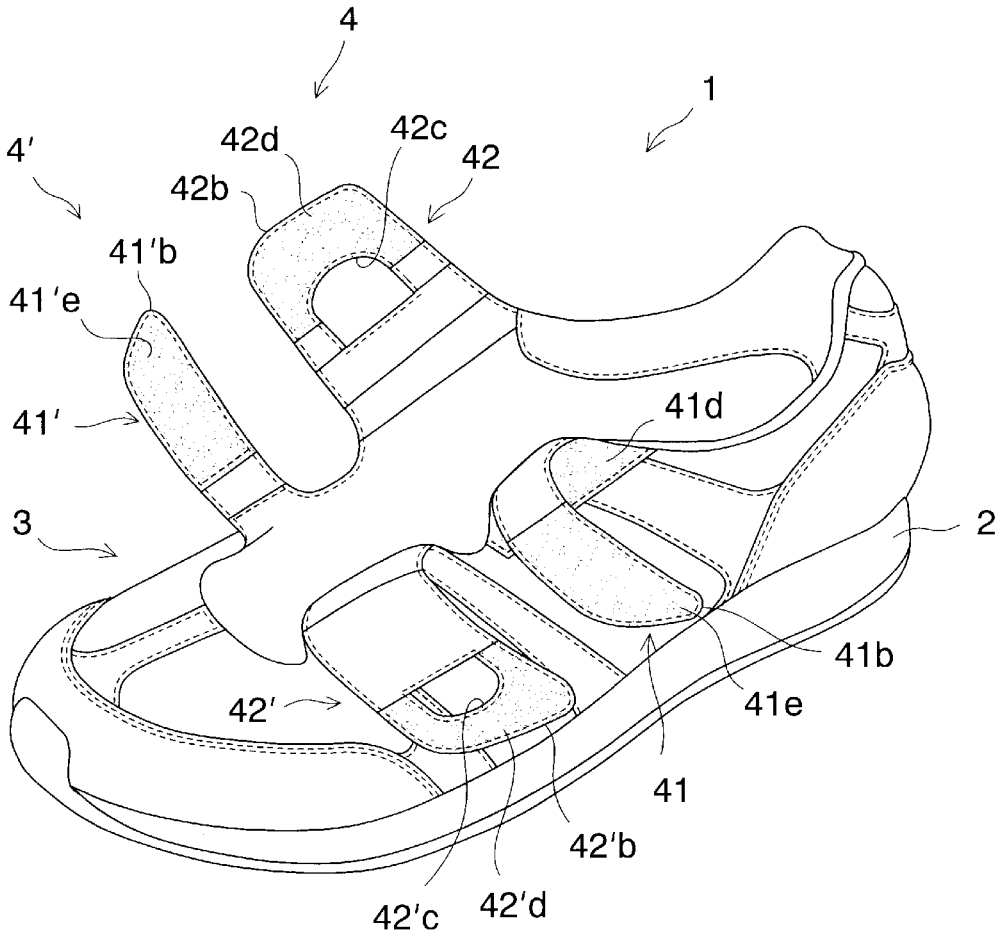
FIG. 5 is a perspective view of a shoe of FIG. 2 with belt members unfastened.

Referring now to the drawings, FIGS. 2 to 5 illustrate a shoe according to an embodiment of the present invention. FIGS. 2 to 4 respectively show a lateral side, medial side and top side of a shoe with belts fastened. FIG. 5 shows a shoe with the belts unfastened.

As shown in FIGS. 2 to 4, a shoe 1 is comprised of a sole 2 and an upper 3 attached on the sole 2. An instep portion of the upper 3 located at a region corresponding to an instep of a shoe wearer's foot has an opening portion 3*a* extending in a longitudinal direction or along the length of the shoe. The instep portion is formed of an instep lateral side portion 31 disposed on a lateral side of the opening portion 3*a* and an instep medial side portion 32 disposed on a medial side of the opening portion 3*a*.

There are provided at the instep portion of the upper 3 belt fastening means 4 and 4' that extend across the opening portion 3*a*. In this embodiment, two pieces of belt fastening means 4 and 4' are provided.

The belt fastening means 4 is comprised of a first belt member 41 disposed mainly on the lateral side portion 31 and a second belt member 42 disposed mainly on the medial side portion 32. A proximal end portion 41*a* of the first belt member 41 is connected to the sole 2 on the lateral side portion 31 and a distal end portion 41*b* extends over the opening portion 3*a* to the top portion of the medial side portion 32. Similarly, a proximal end portion 42*a* of the second belt member 42 is connected to the sole 2 on the medial side portion 32 and a distal end portion 42*b* extends over the opening portion 3*a* to the top portion of the lateral side portion 31. In this embodiment, each of the proximal end portions 41*a*, 42*a* of the first and second belt members 41, 42 is directly connected or fixed to the sole 2. Each of the proximal end portions may be connected to the sole through a reinforcement member or strip (not shown) provided on the instep portion of the upper 3.

As shown in FIGS. 2 and 3, the first and second belt members 41, 42 extend along a direction nearly perpendicular to a ridge line L of the instep portion of the upper 3, as viewed from a side of the shoe. That is, a longitudinal center line of each of the first and second belt members 41, 42 is nearly perpendicular to the ridge line L of the instep portion. The ridge line L generally coincides with "a swell line" of a wearer's foot that extends from a position corresponding to a navicular bone of the foot to a position corresponding to a head of a metatarsus of a second or third toe of the foot.

Also, the first and second belt members 41, 42 are disposed at nearly symmetrical positions relative to the opening portion 3*a*. That is, center lines along the lengths of the belt members 41, 42 are nearly symmetrical about the opening portions 3*a*. The second belt member 42 has an elongated aperture 42*c* formed therein to receive the first belt member 41. The elongated aperture 42*c* may extend along the length of the second belt member 42 and it faces the opening portion 3*a*. In this embodiment, the elongated aperture 42*c* extends to the proximal end portion 42*a* of the second belt member 42.

As shown in FIG. 5, a hook and loop fastening material 42*d* is attached on the back surface of the distal end portion 42*b* of the second belt member 42. On the other hand, a corresponding hook and loop fastening material 41*d* is attached on the lateral side portion 31 of the upper 3 to releasably secure the hook and loop fastening material 42*d* of the second belt member 42. Similarly, a hook and loop fastening material 41*e* is attached on the back surface of the distal end portion 41*b* of the first belt member 41, and a corresponding hook and loop fastening material 42*e* is attached on the medial side portion 32 of the upper 3 to releasably secure the hook and loop fastening material 41*e* of the first belt member 41.

The belt fastening means 4' is provided in such a manner that its first and second belt members are located opposite to the first and second belt members 41, 42 of the belt fastening means 4. That is, the belt fastening means 4' is composed of a first belt member 41' that is disposed mainly on the medial side portion 32 of the upper 3 and that extends over the opening portion 3*a*, and a second belt member 42' that is disposed mainly on the lateral side portion 31 of the upper 3 and that extends over the opening portion 3*a*.

A proximal end portion 41'*a* of the first belt member 41' is fixed to the sole 2 on the medial side portion 32, and a distal end portion 41'*b* extends over the opening portion 3*a* to the top portion of the lateral side portion 31. Similarly, a proximal end portion 42'*a* of the second belt member 42' is fixed to the sole 2 on the lateral side portion 31, and a distal end portion 42'*b* extends over the opening portion 3*a* to the top portion of the medial side portion 32. Additionally, the proximal end portions 41'*a*, 42'*a* of the first and second belt members 41', 42' may be connected to the sole 2 through reinforcement strips (not shown) provided on the instep portion of the upper 3.

Each of the first and second belt members 41', 42', shown in FIGS. 2 and 3, as viewed from the side of the shoe, extends in a direction nearly perpendicular to a ridge line L' of the instep portion where the belt members 41', 42' are provided. That is, each of the longitudinal center lines of the belt members 41', 42' is nearly perpendicular to the ridge line L' of the instep portion. This ridge line L', as with the above-mentioned ridge line L, generally corresponds to "the swell line" of the instep portion of a foot that extends from a position corresponding to a navicular bone of the foot to a position corresponding to a head of a metatarsus of a second or third toe of the foot.

Also, the first and second belt members 41', 42' are located at nearly symmetrical positions relative to the opening portion 3*a*. That is, longitudinal center lines of the first and second belt members 41', 42' are nearly symmetrical about the opening portion 3*a*.

The second belt member 42' has an elongated aperture 42'*c* formed therein to receive the first belt member 41'. The elongated aperture 42'*c* may extend along the length of the second belt member 42' and it faces the opening portion 3*a*. In this embodiment, the elongated aperture 42'*c* extends over the proximal end portion 42'*a* of the second belt member 42' to the sole 2. Thus, the second belt member 42' is bifurcated at a region extending from the proximal end portion 42'*a* to the elongated aperture 42'*c*.

A hook and loop fastening material 42'*d* is attached on the back surface of the distal end portion 42'*b* of the second belt member 42', shown in FIG. 5. On the other hand, a hook and loop fastening material 41'*d* is attached on the medial side portion 32 of the upper 3 to releasably secure the hook and loop fastening material 42'*d* of the second belt member 42'. Similarly, a hook and loop fastening material 41'*e* is attached on the back surface of the distal end portion 41'*b* of the first belt member 41', and a hook and loop fastening material 42'*e* is attached on the lateral side portion 31 of the upper 3 to releasably secure the hook and loop fastening material 41'*e* of the first belt member 41'.

According to this embodiment, as mentioned above, the belt members 41, 42, 41' and 42' of the belt fastening means 4 and 4' extend along directions nearly orthogonal to the ridge lines L, L' of the instep portion of the upper 3, as viewed from the side of the shoe, and the oppositely disposed belt members on the medial and lateral side portions 31, 32 are nearly symmetrical relative to the opening portion 3*a*. In other words, as shown in FIG. 4, the corresponding belt members 41, 42 or 41', 42' extend in a generally straight line that is nearly perpendicular to a longitudinal center line of the opening portion 3*a*.

Thus, when each distal end portion of the corresponding belt members of the belt fastening means 4, 4' is pulled in opposite directions, moment of a couple of forces will not occur at the upper 3 and the upper 3 will not be twisted and formed with wrinkles. Thereby, the medial and lateral side portions 32 and 31 of the upper 3 can be equally pulled, the instep portion can be equally secured to a foot, and the whole rear surface of each belt member can be tightly contacted with the instep portion of the shoe. As a result, the whole instep of a foot can be wrapped and held by the upper 3 of the shoe, thereby advancing fittability of the shoe.

Also, since each proximal end portion of the belt members is connected to the sole 2 and each distal end portion extends over the opening portion 3*a*, a foot can be tightly and firmly secured to the sole 2 through medially and laterally extending portions of the belt members when each distal end portion of the belt members are pulled and fastened to the instep portion. In this case, when the proximal end portion of each belt member is formed in such a way that it widens toward the end, wider regions of the instep of a wearer's foot can be wrapped and supported.

Moreover, each of the holes 42*c*, 42'*c* formed in the second belt members 42, 42' is not a slit but an elongated aperture facing the opening portion 3*a* of the upper 3. Thereby, insertion and extraction of the first belt members 41, 41' relative to the second belt members 42, 42' can be conducted with ease and besides, individual differences of the height of an instep or the width of a foot can be absorbed and fittability can be maintained.

Furthermore, in this case, since each belt member is secured to the instep portion of the upper through a hook and loop fastening material without using a metal fitting such as a D-shaped ring, the movement of a foot is not hindered and a shoe wearer does not feel uncomfortable when bending a foot. Additionally, in this case, shown in FIG. 5, the instep portion of the upper 3 can be fully opened by disengaging each belt fastening means 4, 4', thus facilitating ingress and egress of a foot relative to the shoe.

Figure 6:
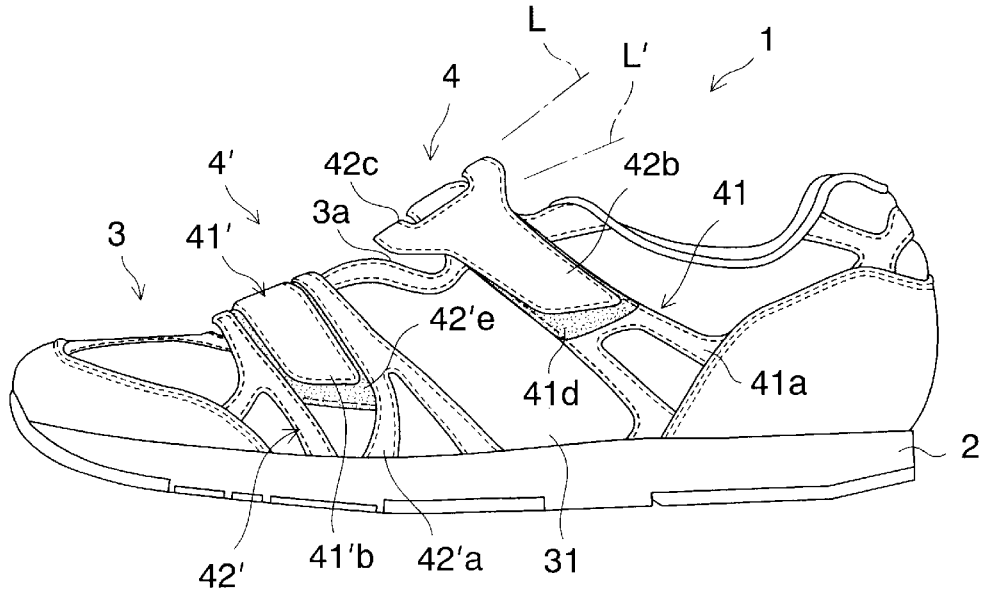
FIG. 6 is a lateral side view of a shoe with belt members fastened according to another embodiment of the present invention.
Figure 7:
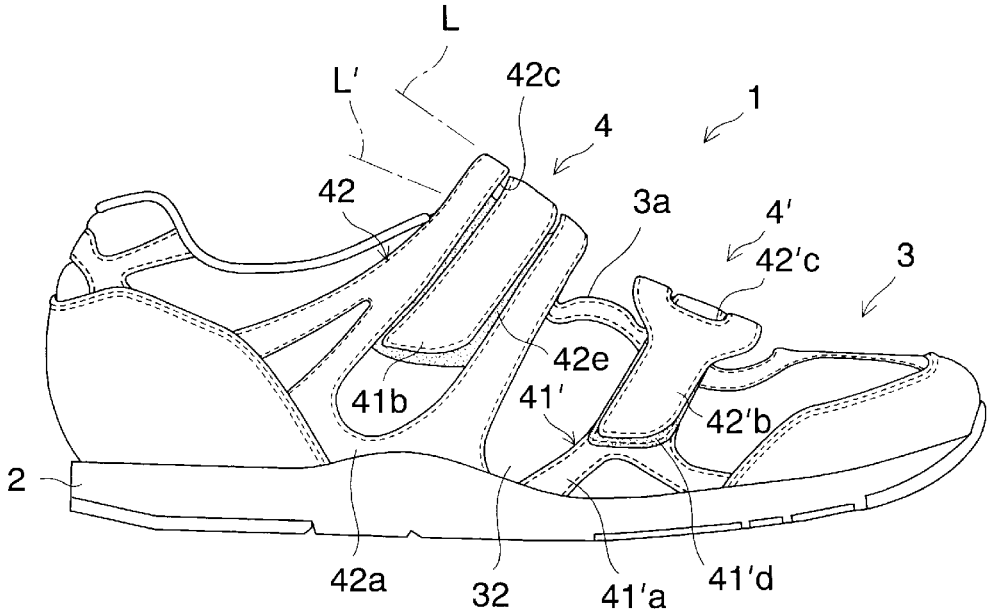
FIG. 7 is a medial side view of a shoe of FIG. 6.
Figure 8:
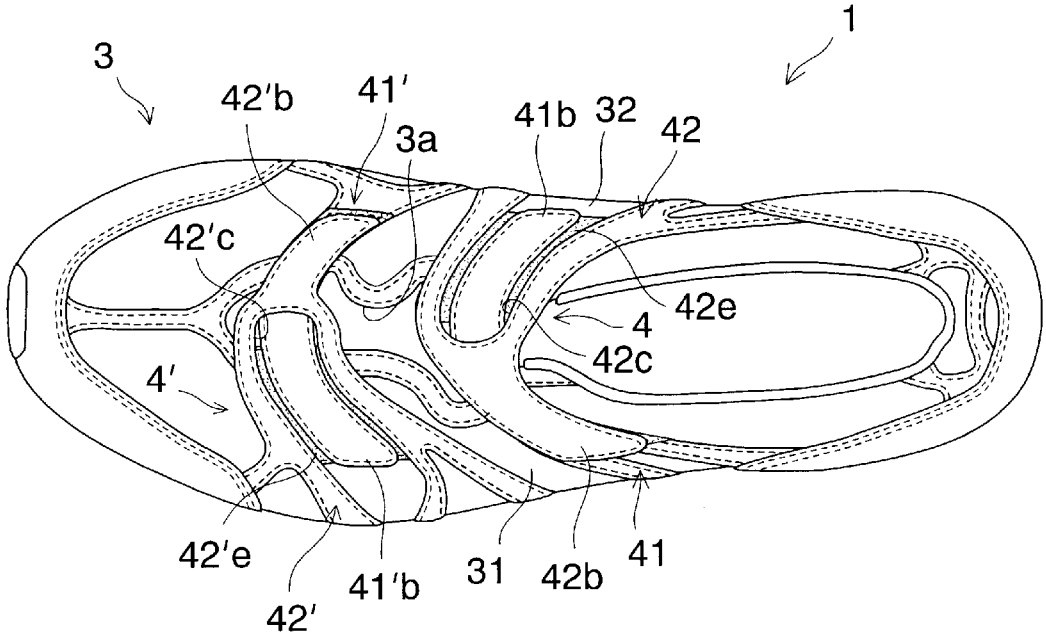
FIG. 8 is a top plan view of a shoe of FIG. 6.

FIGS. 6 to 8 illustrate a shoe according to another embodiment of the present invention. In these drawings, the same reference numerals as those in FIGS. 2 to 5 indicate the same or corresponding parts.

The major difference from the first embodiment is that each distal end portion 42*b*, 42'*b* of the second belt members 42, 42' has a tab. By providing such a tab 42*b*, 42'*b*, a shoe wearer can easily grip the second belt members 42, 42' when fastening the belts, thereby facilitating belt fastening procedures with more ease.

In addition, each of the proximal end portions 41*a*, 41'*a*, 42*a* and 42'*a* of the first and second belt members 41, 41', 42 and 42' has a different shape from that of the first embodiment, but both of them are essentially the same in that they are connected to the sole 2.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A shoe comprising:

a sole; and an upper attached to said shoe;

said upper having a longitudinally extending opening portion formed at an instep portion thereof, said instep portion having a medial side portion located on a medial side of said opening portion, a lateral side portion located on a lateral side of said opening portion, and a belt fastening means provided transversely across said opening portion;

said belt fastening means comprising a first band-shaped belt member disposed mainly on one of said medial and lateral side portions of said upper and a second bifurcated belt member disposed mainly on the other of said medial and lateral side portions of said upper, said first and second belt members being located at generally symmetrical positions with respect to said opening;

said first band-shaped belt member having a proximal end portion fastened to said sole and a distal end portion extending over said opening portion, said first band-shaped belt member extending in a direction generally perpendicular to a ridge line of said instep portion as viewed from a side of the shoe;

said second bifurcated belt member having a pair of proximal end portions each fastened to said sole and a distal end portion extending over said opening portion, said second bifurcated belt member extending in a direction generally perpendicular to said ridge line of said instep portion as viewed from the side of the shoe, said second bifurcated belt member having an elongated aperture between said pair of proximal end portions into which said first band-shaped belt member is inserted, said distal end portion of said first band-shaped belt member having a smaller width than a width of said elongated aperture of said second bifurcated belt member, said elongated aperture facing said opening portion;

said first and second belt members being releasably secured on said instep portion through hook and loop fastening materials provided on said first and second belt members.

2. The shoe according to claim 1, wherein said proximal end portion of said first band-shaped belt member or said second bifurcated belt member is connected to said sole through a reinforcement member provided on said instep portion.

3. The shoe according to claim 1, wherein said second bifurcated belt member has a band-shaped tab formed integral with said distal end portion thereof.

4. The shoe according to claim 1, wherein a plurality of pairs of said belt fastening means are provided.

* * * * *